US006645083B1

(12) United States Patent
Armstrong, III et al.

(10) Patent No.: US 6,645,083 B1
(45) Date of Patent: Nov. 11, 2003

(54) GOLF TRAINING TOOL PROVIDING AUDIO FEEDBACK

(75) Inventors: Walter E. Armstrong, III, Chicago, IL (US); Terrence P. Anton, Chicago, IL (US)

(73) Assignee: Snag, Inc., Lakeland, FL (US)

( * ) Notice: Subject to any disclaimer, the term of this patent is extended or adjusted under 35 U.S.C. 154(b) by 0 days.

(21) Appl. No.: 09/935,942

(22) Filed: Aug. 23, 2001

Related U.S. Application Data

(60) Provisional application No. 60/264,132, filed on Jan. 25, 2001.

(51) Int. Cl.[7] ..... A63B 69/36

(52) U.S. Cl. ..... 473/224; 473/234; 473/226; 473/231

(58) Field of Search ..... 473/224, 234, 473/201, 203, 206, 219, 333, 223, 226, 227, 231

(56) References Cited

U.S. PATENT DOCUMENTS 3,215,437 A * 11/1965 Wess
3,498,616 A * 3/1970 Hurst
4,090,711 A * 5/1978 Amato
5,524,892 A * 6/1996 Karp
6,461,163 B1 * 10/2002 Gallagher

* cited by examiner

*Primary Examiner*—Sebastiano Passaniti
(74) *Attorney, Agent, or Firm*—Piper Rudnick

(57) ABSTRACT

A golf training tool for teaching a proper golf swing, and a method of using the training tool. The golf training tool includes a gripping portion and an audio feedback mechanism. The audio feedback mechanism includes an elongated tube having first and second ends, which is attached at the second end to the gripping portion and is open at the first end. The tube has interior surface walls defining a hollow interior, and a slide member is provided in sliding engagement with the interior surface walls. A cap having a breather vent is provided for the open first end of the tube, and acts as a stop for the slide member.

5 Claims, 3 Drawing Sheets

GOLF TRAINING TOOL PROVIDING AUDIO FEEDBACK

This application claims the benefit of Provisional application No. 60/264,132 filed Jan. 25, 2001.

FIELD OF THE INVENTION

The present invention relates to a method and apparatus for training a golfer to swing a golf club. More particularly, the method and apparatus utilizes audio feedback to alert a golfer of the position of the training tool.

BACKGROUND

The game of golf has become increasingly popular, and there exist many educational tools for teaching a user the various techniques necessary to master the golf swing. However, many of the conventional training tools are expensive, and do not provide the user with immediate feedback useful in teaching the appropriate orientation of the club during various points along the golf swing.

Accordingly, an object of the present invention is to provide an improved inexpensive golf training tool useful in teaching an appropriate golf swing.

A further object is to provide a golf training tool which utilizes audio feedback to alert the user as to the orientation of the golf training tool during a swing.

DETAILED DESCRIPTION OF THE PREFERRED EMBODIMENTS

Figures 1A, 1B:
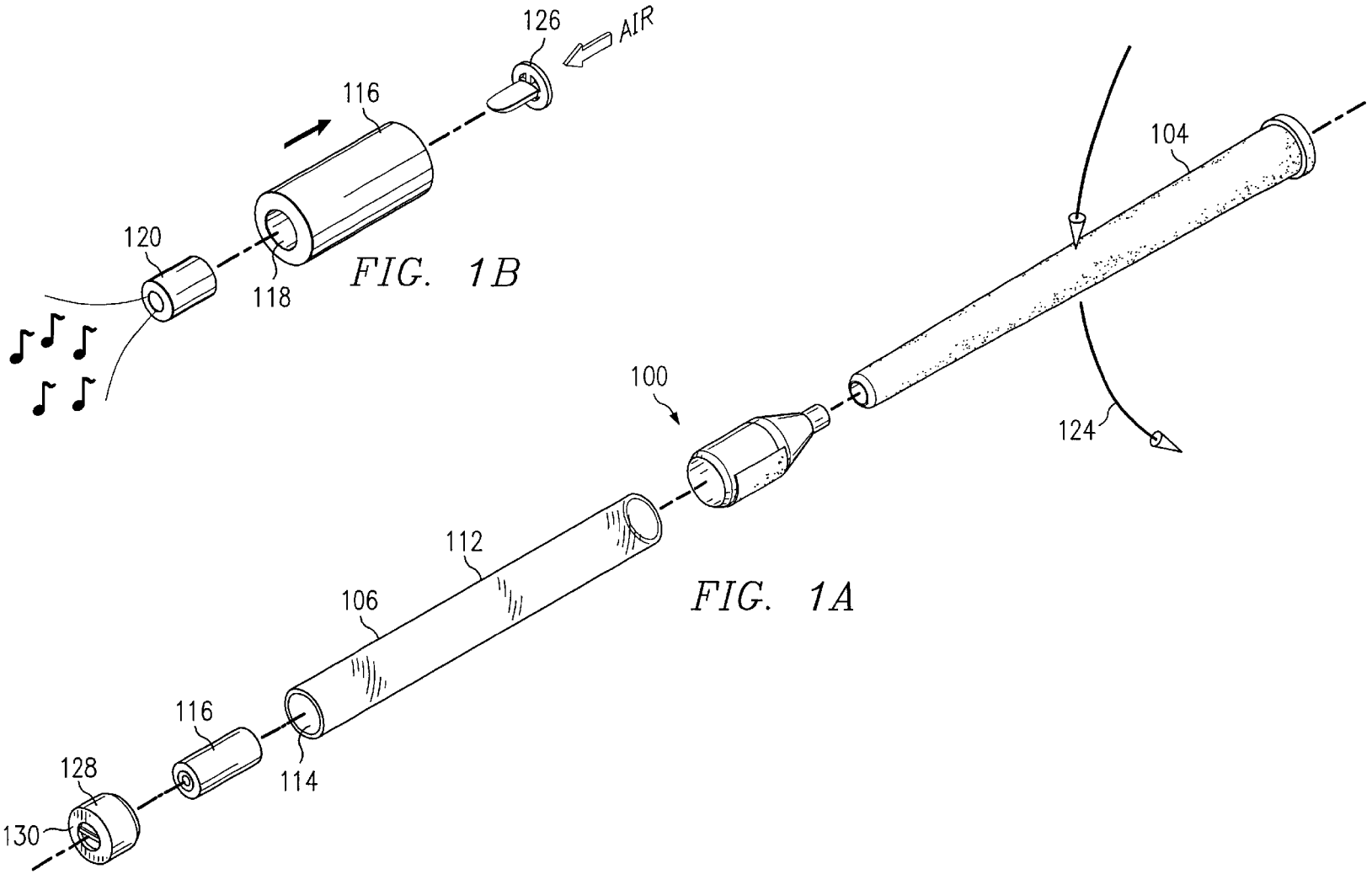
FIG. 1A is an exploded view of the golf training tool of the present invention.
FIG. 1B is an enlarged view of the feedback mechanism used in the golf training tool of FIG. 1A.

FIG. 1A is an exploded view of a golf training tool, generally designated 100, used for providing audio-feedback for teaching a proper golf swing. The golf training tool 100 includes a gripping portion 104 at one end, and a feedback mechanism 106 at an opposing end. The feedback mechanism 106 is designed to provide audio feedback to alert the user when the training tool 100 is positioned correctly.

According to a preferred embodiment, the gripping portion is generally the size and shape of a conventional golf club handle, and is gripped using the conventional two-handed golf grip (hand positioning).

According to a preferred embodiment, the feedback mechanism 106 includes an elongated hollow tube 112 having interior side walls 114. A slide member 116 is provided in the tube 112 in sliding engagement with the interior side walls 114. The slide member is configured to emit an audible sound as the slide member slides within the tube 112. The pitch of the sound emitted changes as a function of the slide member's 116 position within the tube 112; as the slide member 116 approaches the cap 128, the pitch increases.

As best seen in FIG. 1B, a through hole 118 is defined along a longitudinal axis of the slide member 116 such that air passes through the through hole 118 as the slide member 116 travels along the interior of the tube 112. A reed 126 or the like is provided in communication with the through hole 118, and vibrates when air passes through the through hole 118.

According to a preferred embodiment, the slide member 116 is provided with a weight 120 to facilitate movement of slide member within the hollow tube 112 as the golf training tool is tilted in the direction indicated by arrow 124. Alternatively, the slide member 116 may be formed of a heavier material, such as plastic or wood, thereby eliminating the need for the weight 120.

A cap 128 having an aperture or breather vent 130 is provided to retain the slide member 116 within the tube 112.

According to a presently preferred embodiment, the tube 112, slide member 116, reed 126 and cap 128 are all formed of plastic. Moreover, in the embodiment depicted in FIGS. 1A and 1B the tube 112 is formed of clear plastic. However, other suitable materials may be used instead of plastic, provided that the coefficient of friction between the slide member 116 and the interior walls of the tube 112 allow the slide member to slide freely within the tune 112.

Use of the golf training tool 100 to obtain a full-power swing will now be explained with reference to FIGS. 2A–2D.

Figure 2A:
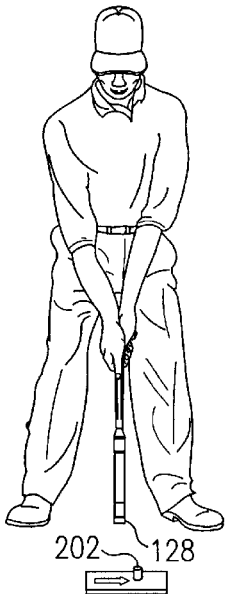
FIG. 2A illustrates a user holding the golf training tool in an initial, 180 degree position.

FIG. 2A illustrates a user 200 holding the golf training tool 100 in an initial, 180 degree position in which the golf training tool is perpendicular to the ground with the cap 128 pointing downward toward pin 202 which represents a hypothetical location of a golf ball. In this position, the gripping portion 104 and the user's arms cooperatively define a "Y" shape. This position corresponds to the conventional starting position in golf when a player aligns a golf club (not illustrated) with the ball.

Figure 2B:
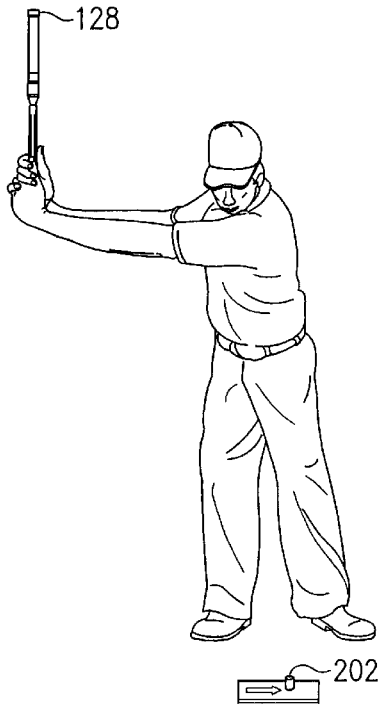
FIG. 2B illustrates a user holding the golf training tool in an intermediate 90 degree position.

FIG. 2B illustrates a user holding the golf training tool 100 in an intermediate, 90 degree position in which the golf training tool is perpendicular to the ground with the cap 128 generally facing upward. In this position, the gripping portion 104 and the user's forearm cooperatively define an "L" shape. The intermediate position shown in FIG. 2B is refereed to as a first power-L position because this position is critical to obtaining a full power golf swing.

Figure 2C:
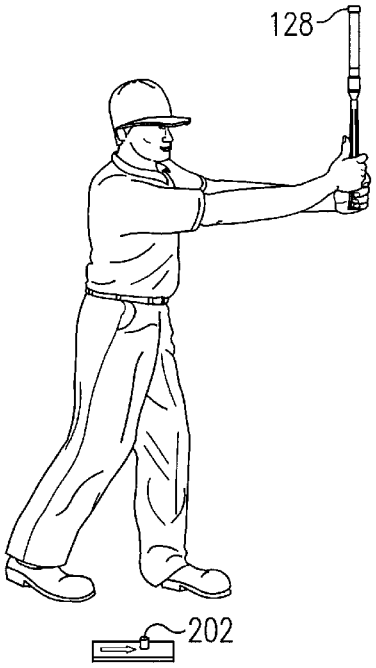
FIG. 2C illustrates a user holding the golf training tool in a follow-through position for a full power golf swing.

FIG. 2C illustrates a user holding the golf training tool 100 in a follow-through position for a full power golf swing in which the golf training tool is once again perpendicular to the ground with the cap 128 generally facing upward. Again, the gripping portion 104 and the user's forearm cooperatively define an "L" shape. The follow-through position shown in FIG. 2C is refereed to as a second power-L position because this position is critical to obtaining a full power golf swing.

Figure 2D:
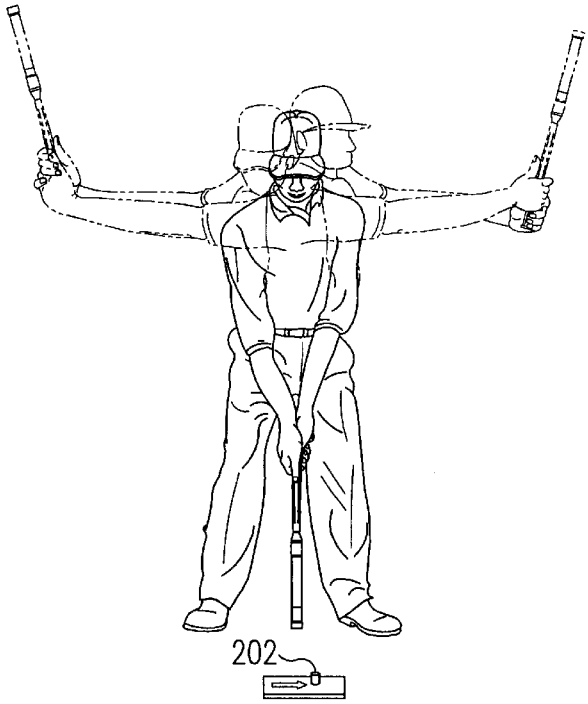
FIG. 2D is a composite view of FIGS. 2A–2C.

FIG. 2D is a composite drawing showing the golf training tool being swung from the initial position (FIG. 2A), backwards to the intermediate position (FIG. 2B), and then through the initial position to the follow-though position (FIG. 2C).

The golf training tool 100 is useful in training a user 200 on a proper golf swing technique. Notably, a full power golf swing is obtained when the golf training tool 100 (golf club)

retracted in a continuous, fluid motion, from the initial position illustrated in FIG. 2A to the intermediate position shown in FIG. 2B and then, in a continuous fluid motion, swung forward (through the initial position) to the follow-through position shown in FIG. 2C.

The golf training tool 100 provides audio feedback to the user regarding the positioning of the golf training tool. More particularly, the golf training tool 100 emits a whistling sound when rotated in the direction of arrow 124 (FIG. 1A) thereby causing the slide member to slide in the interior of the hollow tube 112. The whistling sound is generated by air passing through the through hole 118 and vibrating the reed 126 when the slide member 116 slides. The intensity of the whistling sound is related to the rotational angle of the golf training tool 100, with a steeper angle causing the slide member to slide faster and generating a greater intensity whistling sound. The greatest intensity whistling sound is generated when the golf training tool 100 is rotated 180 degrees, e.g., from the initial position (FIG. 2A) to the intermediate or first power-L position (FIG. 2B), or from the intermediate position through the initial position into the follow-through or second power-L position (FIG. 2C).

Notably, when the golf training tool 100 is retracted in a continuous, fluid motion, from the position illustrated in FIG. 2A through the intermediate position shown in FIG. 2B, the golf training tool 100 will emit a first whistling sound. Further, as the golf training tool 100 is retracted from the position illustrated in FIG. 2B to the follow-through position shown in FIG. 2C, the golf training tool 100 will emit a second whistling sound.

The whistling sound will also exhibit a rate of change of pitch which is a function of the acceleration and rotational speed of the golf training tool. The sound intensity and rate of pitch change sensed by the user can be used as a measurement of rotational speed.

The intermediate position is known as the first power-L position because the user's arm is bent into the shape of an "L" when the arm at the end of the rearward stroke, i.e., as the tool is moved away from the imaginary golf ball. Similarly, the follow-through position (FIG. 2C) is known as the second power-L position because the user's arm is once again bent into the shape of an "L" at the end of the forward stroke following through after contact with the imaginary golf ball.

Figure 3:
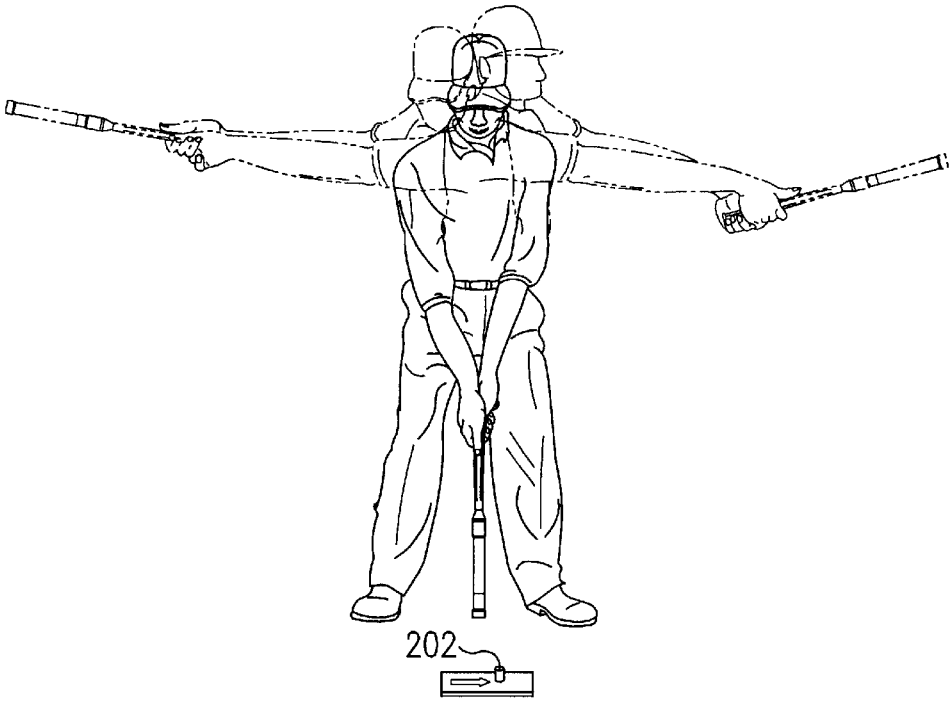
FIG. 3 is a composite view of a user holding the golf training tool of FIG. 1 in an improper stance.

FIG. 3 is a composite drawing showing improper positioning of the golf training tool 100. Notably, the golf training tool 100 is not perpendicular to the ground in either the intermediate or the follow-through position.

The golf training tool 100 may also be used to train the golfer to obtain an intermediate power (pitching) golf swing.

Figure 4:
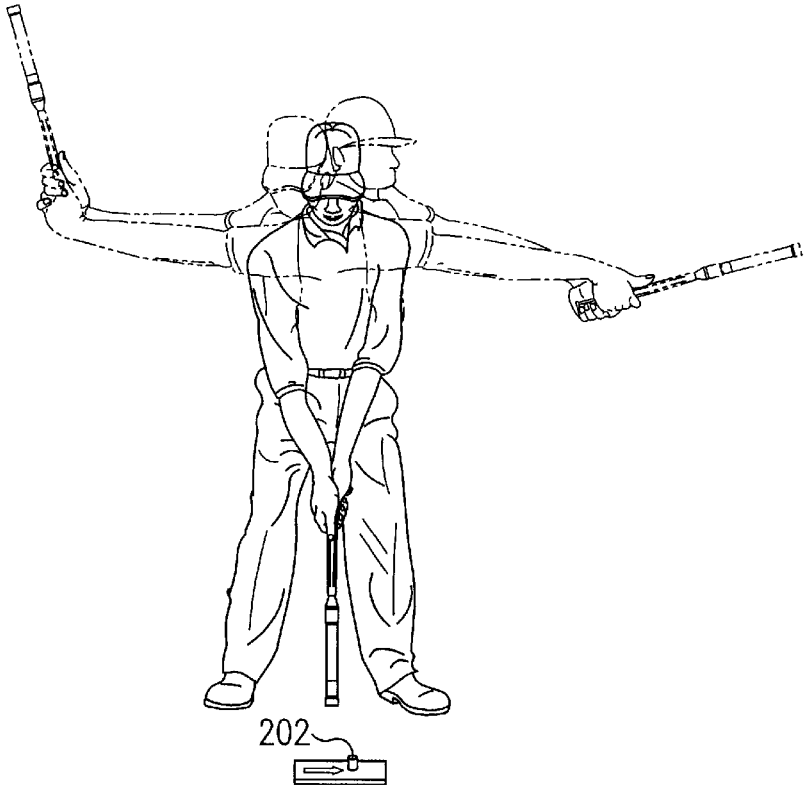
FIG. 4 is a composite view showing use of the training tool to obtain an intermediate power (pitching) golf swing.

FIG. 4 is a composite drawing showing positioning of the golf training tool 100 to obtain intermediate power.

Like the full power swing, the intermediate power swing starts with the user holding the training tool 100 in the initial position (FIG. 2A). Likewise, the same intermediate position (FIG. 2B) is used for the intermediate power (pitching) swing. The intermediate power swing differs from the full power swing in that the follow-through position does not reform the second power L. See, FIG. 5. Thus, the feedback mechanism 106 will provide a lower intensity sound and smaller rate of pitch change, as audio feedback for an intermediate power (pitching) swing than a full power swing.

Thus, the follow-through position for an intermediate power golf swing which is somewhat less than the 270 degree position used in the full power golf swing. Notably, the user 200 adjusts the position in accordance with the amount of power required.

It should be noted that the user's arms generally maintain the Y-shape of the initial position (FIG. 2A), although the "Y" in FIG. 5 is generally rotated 90 degrees relative to the position shown in FIG. 2A.

While a preferred embodiment has been described above and illustrated in the appended drawings, the invention is not limited thereto but by the scope and spirit of the appended claims.

We claim:

1. A golf training tool for teaching a proper golf swing, comprising:

a handle portion; and an audio feedback mechanism attached to said handle portion providing audio feedback in relation to an orientation of the handle portion wherein said audio feedback mechanism comprises:

a closed elongated tube having first and second ends, said second end of said tube being attached to said handle portion, said tube having interior surface walls defining a hollow interior and an axis; and a slide member having a through hole substantially aligned with the axis and in sliding engagement with said interior surface walls, said slide member emitting an audible sound through said through hole as it travels along said hollow interior of said tube.

2. The golf training tool according to claim 1, wherein said handle portion resembles a golf club handle.

3. The golf training tool according to claim 1, further comprising a cap engaging said first end of said tube, and said cap having a breather vent.

4. The golf training tool according to claim 1, further comprising a weight mounted to said slide member.

5. The golf training tool according to claim 1, wherein:

said slide member is configured to emit a first audible indication as said handle portion is swung from an initial position to an intermediate position, and emit a second audible indication as said handle portion is swung from said intermediate position to a follow-through position;

an intensity of said first audible indication providing audible indication of whether the tube was properly oriented as the golf training tool was swung from said initial position to said intermediate position; and an intensity of said second audible indication providing audible indication of whether the tube was properly oriented as the golf training tool was swung from said intermediate position to said follow-through position.

* * * * *